United States Patent [19]

Zaehring

[11] 3,955,898

[45] May 11, 1976

[54] LOCKING DEVICE FOR THE ROTOR BLADES OF A FLOW MACHINE

[75] Inventor: Gerhard Zaehring, Munich, Germany

[73] Assignee: Motoren- und Turbinen-Union Munchen GmbH, Munich, Germany

[22] Filed: Aug. 7, 1975

[21] Appl. No.: 602,792

[30] Foreign Application Priority Data

Aug. 13, 1974 Germany ..... 2438757

[52] U.S. Cl. ..... 416/215

[51] Int. Cl.[2] ..... F01D 5/32

[58] Field of Search .....416/215–218, 244 A

[56] References Cited

UNITED STATES PATENTS

| | | | |
|---|---|---|---|
| 3,053,504 | 9/1962 | Shelly | 416/215 |
| 3,088,708 | 5/1963 | Feinberg | 416/215 |
| 3,216,700 | 11/1965 | Bostock | 416/216 |
| 3,383,094 | 5/1968 | Diggs | 416/215 |
| 3,567,337 | 3/1971 | Zerlauth et al. | 416/215 X |

FOREIGN PATENTS OR APPLICATIONS

| | | | |
|---|---|---|---|
| 812,337 | 8/1951 | Germany | 416/215 |
| 659,592 | 10/1951 | United Kingdom | 416/215 |

*Primary Examiner*—Everette A. Powell, Jr.
*Attorney, Agent, or Firm*—Wolfgang G. Fasse; Willard W. Roberts

[57] ABSTRACT

A rotor of a flow machine has a circumferentially extending slot with laterally projecting flanks. A plurality of rotor blades have roots radially locked in the circumferential slot. The rotor blades have pedestals substantially level with the surface of the rotor, and the blade roots or feet are circumferentially slidable in the circumferential slot. The circumferential slot has a blade stacking hole for inserting the blade roots into the slot. A locking device is positioned between the roots of a pair of blade elements. The locking device has a lock foot shaped to engage the sides of the adjacent blade roots. The sleeve is radially movable with the lock foot and rotatable about its own axis. The lock foot is not rotatable. The sleeve has a pair of outwardly extending tangs. A coil spring extends between the bottom of the circumferential slot and the sleeve to urge the sleeve and the lock foot radially outwardly. The tangs, in one angular position of the sleeve engage slots in the undersides of the adjacent pedestals of the pair of blades. In the other angular position the tangs engage a slot formed between the abutting edges of the pedestals of a pair of blades. When the tangs engage the slots at the underside of the pedestals, the locking foot is positioned so that it may be moved circumferentially in the circumferential slot. When the tangs engage a slot between the abutting edges of the pedestals, the lock foot is positioned between the laterally projecting flanks of the circumferential slot and radially with respect to the rotor whereby the locking device cannot be moved circumferentially.

6 Claims, 3 Drawing Figures

LOCKING DEVICE FOR THE ROTOR BLADES OF A FLOW MACHINE

BACKGROUND OF THE INVENTION

This invention relates to flow machines, such as turbines or the like, and is particularly directed to means for locking the rotor blades with respect to circumferential movement in a circumferential slot in the rim of the rotor disk of the flow machine.

In accordance with known practice, the rotor of a flow machine is provided with a circumferentially extending slot, the rotor blades of the machine being locked, with respect to radial movement, in the circumferential slot. For this purpose, the circumferential slot may have laterally projecting flanks. A blade stacking hole is provided in the circumferential slot, in order to enable insertion of the roots of the rotor blades into the circumferential slot, the rotor blades then being circumferentially slidable away from the blade stacking hole. In such arrangements the blade stacking hole has been closed by a blade stop member after the rotor blades have been closely stacked together in the circumferential slot for installation. Such a stop member, in accordance with prior practice comprises a number of parts shaped to suit the differentiated blade pitch of the blades, and also to suit the specific type of blade mounting employed in the machine, taking into consideration such factors as the shape of the slot, and the configuration of the pedestal of the blade.

In such installations, the multi-part blade stop member is generally riveted or wedged to the rim of the rotor.

The assembly of rotor blades on a rotor in such arrangements has proven to be time consuming and expensive in mass production. In addition, the disassembly of the rotor blades, for example, for replacement of the blades, required a substantial amount of work, and was an expensive procedure.

Another drawback of the prior art blade stoppers is seen in their relatively large size which could not only result in an unbalance of the rotor disk or of the entire rotor of the flow machine, but which could also cause a rather critical reduction in the thickness of the rim material near the stacking hole in the rotor.

British Pat. No. 903,176 discloses an arrangement aiming at solving such problems. The known blade locking arrangement of this British Patent locks the blades in the circumferential direction by means of a blade stopper, which may be pressed down against a coil spring through the blade stacking hole for insertion into the circumferential slot. Within the blade stacking hole, the locking element is allowed to spring back sufficiently between the last and the next to last blades, to prevent its displacement circumferentially between the laterally projecting flanks of the circumferential slot of the rotor. This known arrangement thus provides a blade locking means which substantially eliminates the need for making the rim material thinner. However, the known blade locking device is not anchored exactly between or with the two end blades in the locked operating position. During displacement of the locking device within the circumferential groove or slot the blade stopper is also not exactly guided, so that it is not easily displaceable circumferentially, whereby assembly and disassembly of the known device is difficult.

OBJECTS OF THE INVENTION

In view of the foregoing, it is the aim of the present invention to achieve the following objects, singly or in combination:

- to remove the above drawbacks by means of a blade locking device for a flow machine to improve the locking especially in the radial direction and with due regard to the high speeds prevailing in such machines;
- to provide a blade stopper for circumferentially locking the rotor blades of a flow machine in a circumferentially extending slot, which stopper is easily mounted and released in a blade stacking hole and, which is readily slidable in the circumferential slot to facilitate the assembly and disassembly of the rotor body and blades;
- to provide a blade locking device constructed in such a manner that operational tensile stresses will not affect the rigid seating of the blade lock;
- to construct the blade locking device in such a manner that substantial modifications of the blades adjacent to the lock are not required; and
- to construct the blade locking device in such a manner that any substantial material thickness reduction of the rotor rim is avoided by making the locking device and the respective blade stacking hole relatively small.

SUMMARY OF THE INVENTION

The invention relates to a blade locking device for the rotor of a flow machine, with a circumferentially extending slot having laterally projecting flanks. The roots of the rotor blades inserted in the slot have such contours that they are radially locked in the circumferential slot except in a blade stacking hole, which is provided in the slot for inserting the roots of the blades into the slot whereby these roots may slide circumferentially in the slot or groove. The locking device is also insertable through said stacking hole into the slot against the bias of a coil spring.

The rotor blades may have pedestals substantially flush with the outer surface of the rotor, to provide the blade rim with a smooth outer contour. The pedestals of adjacent blades abut each other and preferably cover the circumferential slot.

According to the invention the locking device comprises blade stopper means including a stopper foot and a stopper sleeve shaped to correspond at least approximately to the respective contours of the blade roots. The sleeve of the blade stopper means projects centrally and radially outwardly from the blade stopper means. The sleeve is mounted to be rotatable relative to the stopper foot about its own axis extending radially with respect to the rotor. The sleeve is secured to the stopper foot for movement therewith radially relative to the rotor. A coil spring is located in the sleeve and engages the bottom of the circumferential slot in the rotor for urging the stopper or locking foot and the sleeve radially outwardly.

The radially outer end of the sleeve opposite the slot bottom has a pair of tangs extending radially outwardly relative to the rotational axis of the rotor. These tangs are located to engage, in one angular or rotated position of the sleeve, grooves arranged opposite each other in the under surfaces of the pedestals. The coil spring urges the tangs into these grooves which are provided in the lateral pedestal flanks facing each other. In another angular or rotated position of the sleeve the tangs engage a gap defined between the abutting edges of the pedestals of the rotor blades. The grooves and gap are displaced relative to each other by 90°. Hence the sleeve is to be rotated into the locking position. In this rotated position in which the tangs snap into the gap, the sleeve and the locking foot are urged radially outwardly by the coil spring. Thus, the blade stopper is operational to prevent its displacement in the circumferential slot to thereby circumferentially lock the rotor blades in position.

The arrangement in accordance with the invention thus enables the locking of the rotor blades in a simple and expedient manner. The circumferential rotor slot does not require any substantial material removal to permit the insertion and locking of the blade stopper and the rotor blades may be easily assembled and disassembled. The locking device is anchored or positioned exactly between the last installed blades in the operating position, as well as during displacement within the circumferential slot. This is advantageous especially for displacing the locking device in the circumferential direction, since the exact positioning prevents wedging or binding and since the tangs engaging the grooves in the pedestals of the last installed blades sufficiently depress the locking device against the force of the coil spring to relieve the locking foot of the bias of the coil spring. The depression of the coil spring and subsequent rotation of the sleeve permits the tangs to engage the gap between the abutting surfaces of adjacent pedestals, whereby the blade stopper is locked in a simple manner. In addition to its simple and hence inexpensive features, the present locking device is rather reliable as compared with known arrangements.

BRIEF FIGURE DESCRIPTION

In order that the invention may be clearly understood, it will now be described, by way of example, with reference to the accompanying drawings, wherein:

FIG. 1 is a plan view of a portion of a rotor disk fitted with a blade locking device in accordance with the invention; and FIG. 2 is a sectional view of a portion of a rotor disk taken along the line I—I of FIG. 1; and FIG. 3 is a perspective partially broken away view of the blade locking device according to the invention.

DETAILED DESCRIPTION OF EXAMPLE EMBODIMENTS

Figure 2:
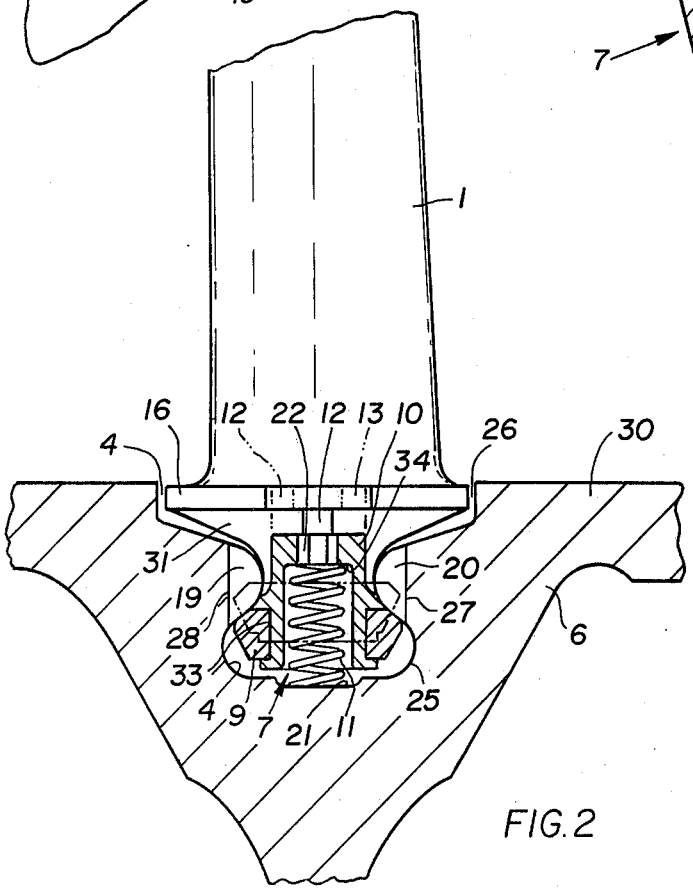

The rim 6 of a rotor disk 5 is provided with a circumferentially extending slot 4 having laterally inwardly projecting opposed flanks 19, 20. The lower portion 25 of this slot has a rounded, increased width and the open upper portion 26 of the slot also has an increased width. In at least one circumferential location the slot 4 is provided with a radially extending blade stacking hole 8, in which the laterally projecting flanks 19, 20 are removed, whereby the central portion of the blade stacking hole has substantially radially extending edges 27, 28 as illustrated in FIG. 2. The stacking hole 8 has a circumferential extent substantially equal to the circumferential length of the root of the blade.

Figure 1:
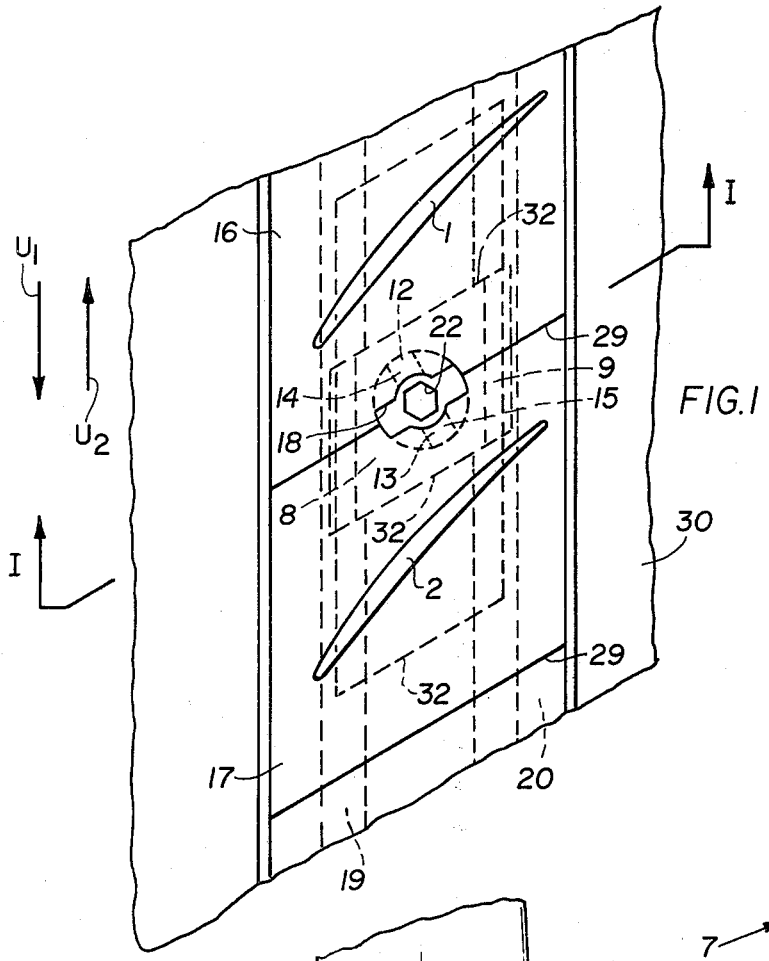
Figure 3:
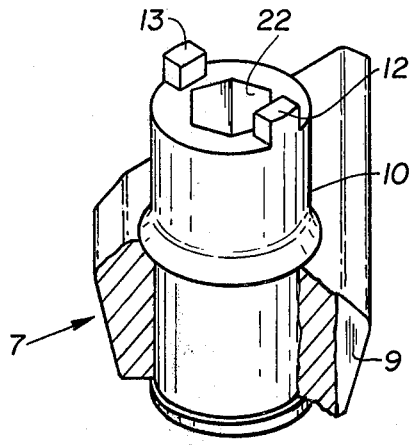

As illustrated in FIG. 1, the rotor blades 1 and 2 extend radially, with respect to the rotational axis of the rotor from pedestals 16, 17 respectively. The pedestals 16, 17 have a width substantially equal to the width of the upper portion 26 of the slot 4, and the side edges of the pedestals abut each other along the joints 29, which preferably extend in planes at angles to the axis of the rotor 30.

The rotor blades are provided with blade roots, for example, the blade root 31 extending radially inwardly from the pedestal 16. These blade roots have contours substantially matching the contour of the slot 4 in the region thereof away from the blade stacking hole 8. The blade roots have circumferential dimensions less than the pedestals 16, 17 as indicated by the dashed lines 32 (FIG. 1) representing the side edges of the blade roots which may extend in parallel to the joints 29. FIG. 1 shows that the edges of the blade stacking hole 8 extend at the same angle as the edges of the roots of the blades. Hence, the roots of the blades may be inserted into the blade stacking hole 8 and then slipped circumferentially around the rotor in the slot 4, whereby the lateral projecting flanks 19, 20 prevent radial displacement of the blades in the region away from the blade stacking hole 8.

In the illustrated embodiment of the invention, the rotor blade 1 is the next to the last blade assembled to the rotor disk 30 and the blade 2 is the last rotor blade to be assembled in the rotor disk, at least with respect to the illustrated blade stacking hole 8. Further, as illustrated in FIG. 1, the joint 29 between the pedestals of these two blades extends about centrally across the blade stacking hole 8. The manner of assemblying the blades in this position will be discussed in greater detail in the following paragraphs.

A blade locking device 7 is arranged in the blade stacking hole 8 between the blade roots of the blades 1 and 2. The blade locking device 7 comprises a lock foot 9 having side edges abutting the adjacent side edges of the roots of the blades 1 and 2. The lock foot 9 has a width greater than the distance between the laterally projecting flanks 19 and 20 of the circumferential rotor groove. A sleeve 10 is rotatably secured to the foot 9 in a radially extending aperture in the center of the foot 9. For example, the sleeve 10 may have an annular groove 33 engaging the sides of the aperture in the foot 9. whereby the sleeve 10 may be rotated with respect to its foot 9, but is restrained from radial dispacement with respect to the foot 9. The sleeve 10 has an enlarged, radially extending hole in which a coil spring 11 is mounted. The bottom of the coil spring 11 rests against the base of the slot 4. The radially outer end of the spring 11 extends to engage a shoulder 34 in the sleeve 10, whereby the spring 11 urges the sleeve 10 and the foot 9 radially outwardly with respect to the rotor 30. The sleeve 10 may also be provided with a hexogonal radially extending hole 22, at its radially outer end for rotating the sleeve 10 by means of an Allen wrench insertable into the hole 22.

As illustrated in FIG. 1, the blade pedestals 16, 17 are provided in their under surface with diametrically opposite slots 14, 15 with respect to the axis of the sleeve 10. The radially outer edge of the sleeve 10 has a pair of radially extending tangs 12, 13 which engage the slots 14, 15 respectively in the solid line position of these elements illustrated in FIG. 2.

As illustrated in FIG. 1, a gap 18 extends between the abutting edges of the blade pedestals 16, 17 at the respective joint 29.

The gap 18 extends at right angles to the slots 14, 15 and is centrally disposed with respect to the axis of the sleeve 10, whereby upon rotation of the sleeve 10, the tangs 12, 13 may engage the slot 18 to lock the locking device in position.

In the solid line position of the foot 9 and the sleeve 10 as illustrated in FIG. 2, the spring 11 has been compressed, for example, by the application of a radially inward force to the sleeve 10. In this position the foot 9 is depressed radially inwardly in the blade stacking hole 8, so that it clears the projecting flanks 19, 20 of the slot 4. In this position, with the spring depressed, the blade locking device 7 may be slipped longitudinally in the slot 4, whereby the tangs 12 and 13 engage the slots 14 and 15 respectively in the undersides of the blade pedestals 16 and 17 and if the locking device 7 is within the blade stacking hole 8, the foot 9 and sleeve 10 are restrained against radially outward displacement.

Since the sleeve 10 is rotatable with respect to its foot 9, the tangs 12, 13 may be rotated with the sleeve 10 90° so that they engage the slot 18 in the pedestals 16, 17. Upon such rotation of the sleeve 10, if the locking device is within the blade stacking hole 8, the tangs 12, 13 are forced radially outwardly by the spring 11, so that the tangs enter the slot 18 and the foot 9 takes up the position illustrated by dashed lines in FIG. 2. In this position, the sides of the lock foot 9 engage the sides of the projecting flanks 19, 20 in the blade stacking hole 8 to prevent circumferential movement of the locking device 7 in the slot 4. Hence, in this position of the locking device 7, it prevents the circumferential displacement of the blades 1 and 2.

As is apparent in FIG. 2, the blade stacking hole 8 may optionally be provided with a recess 21 at the bottom of the slot 4, for improved retention of the radially inward end of the coil spring 11.

When assemblying the rotor blades in the slot 4 of the rotor in accordance with the invention, the next to the last rotor blade 1 is inserted through the blade stacking hole 8 and this blade is then slipped circumferentially around the rotor, in the slot 4 in the direction indicated by the arrow $U_2$ in FIG. 1. The blade locking device 7 is then inserted in the circumferential slot 4 through the blade stacking hole 8 and likewise moved in the circumferential direction $U_2$ until it engages the blade root of the rotor blade 1.

Then the last blade 2 is inserted in the circumferential slot 4 through the blade stacking hole 8. This blade 2 is then slipped circumferentially in the slot 4 in the direction $U_1$ opposite to the direction $U_2$ until it is positioned, as illustrated in FIG. 1, with its edge extending generally at the center of the blade stacking hole. All blades and the locking device 7 are then displaced until the locking device 7 registers with the stacking hole 8. In order to slide the locking device 7 in the slot 4 during its installation, it is depressed against the spring 11 by applying a radially inward force to the sleeve 10 so that the foot 9 thereof may clear the lateral, projecting flanks 19 and 20. Once the locking device 7 has been positioned so that the tang 12 engages the slot 14 in the underside of the pedestal 16, the spring 11 will remain depressed, so that the locking device 7 may be moved along with the blade 1 into the position illustrated in FIG. 1.

When the locking device 7 registers with the stacking hole 8 it is depressed against the spring 11 whereby the tangs 12, 13 are forced radially inwardly out of the slots 14, 15. The sleeve 10 may then be rotated by means of an Allen wrench to align the tangs 12, 13 with the slot 18. Upon release of the radially inwardly directed force on the sleeve 10, the spring 11 urges the tangs 12, 13 radially outwardly so that they enter the slot 18, whereby circumferential movement of the blades and of the locking device 7 is inhibited.

In order to disassemble the device, the order of the above steps of installation is reversed.

The blade stacking hole 8 is covered by the blade pedestals 16 and 17 of the last two blades 1, 2 when the locking device 7 is in its operating position, as illustrated in FIG. 1.

Although the invention has been described with reference to specific example embodiments, it is to be understood, that it is intended to cover all modifications and equivalents within the scope of the appended claims.

What is claimed is:

1. In a flow machine of the type having a rotor with a circumferential slot in its rim, the circumferential slot having laterally projecting flanks, a plurality of rotor blades radially locked in said circumferential slot by said projecting flanks, a blade stacking hole in said circumferential slot to enable insertion of the roots of said rotor blades in said circumferential slot, whereby the roots of said rotor blades may be circumferentially slid in said circumferential slot, a locking device in said circumferential slot between the roots of a pair of blades, said locking device being insertable in said blade stacking hole and having a coil spring, wherein said locking device may be locked circumferentially within the blade stacking hole between said laterally projecting flanks with the assistance of the restoring force of said coil spring; the improvement wherein said locking device comprises a lock foot having sides engaging the sides of the roots of a pair of said rotor blades, a sleeve mounted for rotation in said lock foot and having an axis that extends radially with respect to said rotor, said sleeve projecting centrally, radially, outwardly from said lock foot, said coil spring being mounted to urge said lock foot and sleeve radially outwardly with respect to said rotor, said rotor blades having pedestals substantially aligned with the radially outer surface of said rotor, a pair of said pedestals having opposed grooves in their radially inward surfaces, a pair of tangs on the radially outer end of said sleeve, said tangs projecting radially with respect to the axis of said rotor and being positionable to engage said grooves in said pedestals, said grooves in said pedestals extending diametrically opposite with respect to the axis of said sleeve, the pedestals of said pair of rotor blades abutting each other circumferentially, a gap formed between the abutting edges of said pedestals, said gap being positioned at substantially right angles to said grooves, in the radial undersides of said pedestals, said tangs being positioned to engage said gap in said abutting edges upon rotation of said sleeve, whereby said locking device may be positioned in said blade stacking hole between said laterally projecting flanks when said tangs engage said gap in said abutting edges.

2. The flow machine of claim 1, wherein a recess is provided in the bottom of said circumferentially extending slot, the radially inner end of said coil spring engaging said recess when said locking device is in said blade stacking hole.

3. The flow machine of claim 1, wherein said sleeve has an internal shoulder, said coil spring extending between said shoulder and a bottom of said circumferential slot.

4. The flow machine of claim 3, further comprising a recess in the bottom of said slot in the region of said blade stacking hole, whereby the radially inner end of said coil spring rests in said recess.

5. The flow machine of claim 1, wherein said sleeve has a circumferentially extending recess, said lock foot engaging said recess, whereby said lock foot and said sleeve are secured to each other with respect to radial movement and said sleeve is rotatable about its own axis with respect to said lock foot.

6. In a locking device for the blades of a rotor of a flow machine which blades are insertable into a contoured circumferential slot in the rotor, the improvement comprising a locking foot and a locking sleeve, said locking foot having a sectional contour substantially corresponding to that of said contoured circumferential slot and an aperture in said locking foot, said sleeve having shoulders engaging said aperture of the locking foot whereby the sleeve is movable with the locking foot but rotatable relative thereto, said sleeve further comprising locking tangs extending axially of the sleeve opposite said locking foot, and means in said sleeve arranged for cooperation with spring means to urge the sleeve and locking foot in a direction radially relative to said rotor.

* * * * *